United States Patent [19]

Kashio

[11] 4,133,170

[45] Jan. 9, 1979

[54] GLOBAL TIMEPIECE

[75] Inventor: Toshio Kashio, Tokyo, Japan

[73] Assignee: Casio Computer Co., Ltd., Tokyo, Japan

[21] Appl. No.: 854,052

[22] Filed: Nov. 23, 1977

Related U.S. Application Data

[63] Continuation of Ser. No. 681,068, Apr. 28, 1976, abandoned.

[30] Foreign Application Priority Data

Apr. 30, 1975 [JP] Japan ..... 50-52366

[51] Int. Cl.[2] ..... G04B 19/22

[52] U.S. Cl. ..... 58/42.5; 58/4 A; 58/50 R

[58] Field of Search ..... 58/4 R, 4 A, 42.5, 23 R, 58/50 R

[56] References Cited

U.S. PATENT DOCUMENTS

| | | | |
|---|---|---|---|
| 3,186,158 | 6/1965 | Miller | 58/42.5 |
| 3,333,410 | 8/1967 | Barbella | 58/4 R |
| 3,653,204 | 4/1972 | Miwa | 58/42.5 |
| 3,733,810 | 5/1973 | Girard | 58/23 R X |
| 3,822,545 | 7/1974 | Catto et al. | 58/23 R |
| 3,940,920 | 3/1976 | Nakamura et al. | 58/4 A |

*Primary Examiner*—Ulysses Weldon
*Attorney, Agent, or Firm*—Flynn & Frishauf

[57] ABSTRACT

A global timepiece provided with a counting circuit for electronically counting at least seconds, minutes, hours, days and months upon receipt of a signal from a pulse oscillator and particularly a control circuit for advancing a date from the last day of a given month to the first day of the following month according to a calendar, which comprises a date-counting circuit for counting a day by an advance pulse generated per day; a day-detecting circuit for detecting a count of "1" representing the first day of a calendar month which has been counted by the day-counting circuit; a circuit for setting the count made by said day-counting circuit at a "0" upon receipt of an output signal denoting a count of "1" which has been detected by the day-detecting circuit and also a time correction-instructing signal for backdating a date one day according to an instruction based on a time difference occurring between any two districts in indicating the count of "0" made by the day-counting circuit to represent the last day of each preceding month in the form of a specific notation.

10 Claims, 7 Drawing Figures

GLOBAL TIMEPIECE

This is a continuation of application Ser. No. 681,068, filed Apr. 28, 1976 now abandoned.

This invention relates to a timepiece capable of indicating the time and date of a given district having a certain time difference from another district taken as a base, and more particularly to a timepiece provided with improved means for changing a date of the base district from the first day of the current month to the last day of the preceding month by reference to the certain time difference of said given district.

Where a timepiece indicating both time and date is demanded at a given district taken as a base to indicate the current time of another selected district having a certain time difference from the base district by correcting the time of the base district by said time difference, it is sometimes necessary to change both current time and date of the base district depending on the amount of said time difference. With a clock pulse type electronic timepiece, time correction is effected by changing the time counts made by the respective "hour", "minute" and "second" counting circuits corresponding to the aforesaid time difference. Further where time correction based on a time difference happens to extend to a day at a base district preceding that day on which time correction is to be made, then a date also has to be corrected by changing the "day" count made by the day-counting circuit. Where the correction of a date starts with the first day of a given month at the base district, said correction sometimes has to be made to indicate the end of a month preceding the current month of a base district. Depending on the carrent month selected, the preceding month ends on the 30th, 31st, 28th or 29th day. Therefore, before time correction can be made based on a time difference between two remote districts over the world (hereinafter referred to as the "time difference"), it is necessary to find what day represents the last day of the preceding month, and change the count made by the day-counting circuit after determining the last day of the preceding month. With a timepiece of the above-mentioned type, however, time correction based on said time difference from the first day of the current month to the last day of the preceding month occurs only twelve times, and moreover the amount of time correction is limited by the time difference. Such time correction occurs far less frequenctly than when date correction is made from one day to another within the same month. Consequently even provision of a separate circuit for judging what day represents the last day of the preceding month only results in complicating the arrangement of a timepiece for correcting the current time on the basis of a time difference.

It is accordingly the object of this invention to provide a novel type of timepiece free from the above-mentioned drawback, wherein, when time correction based on the time difference is accompanied with the change of a calendar month, a specific common notation is provided to represent all the different days denoting the last days of calendar months preceding the respective selected current months, and the indication of said specific common notation is taken as the change of a date from the first day of the current month to the last day of the preceding month.

SUMMARY OF THE INVENTION

To attain the above-mentioned object, this invention provides a novel type of timepiece including a counter for electronically counting at least hours (including minutes and seconds), days and months upon receipt of a signal from a pulse oscillator and particularly control means for advancing a date from the last day of a month preceding the current month to the first day of said current month. The timepiece also comprises time correction-instructing means for setting a given point of time of a district taken as a base to the corresponding point of time of another remote district having a certain time difference; upcounting means for adding a count of "+1" to a count stored in a day-counting circuit when time correction based on a time difference happens to extend to a day following that day on which time correction is to be made and further advancing a date from the last day of the preceding month to the first day of the current month when time correction based on the time difference enters to the region of said current month; means for subtracting a count of "−1" from a count stored in the day-counting circuit upon receipt of an output from "hour" correction-instructing means when time correction based on the time difference falls within the region of the preceding month, and for representing a count stored in the day-counting circuit by a different code arrangement from those used to denote the ordinary numerical characters appearing on a calendar, instead of subtracting a count of "−1" from a count stored in a month-counting circuit, when time correction based on the time difference ends with the last day of the preceding month; and display means for indicating a specific notation represented by said different code arrangement.

This invention has been accomplished by noticing that with the aforesaid arrangement, where time correction based on the time difference ends with the last day of the preceding month, the "day" count made by the time-counting circuit is down counted one day at maximum, with no possibility of down counting of more than one day being carried out from the geophysical point of view; "0" day does not occur, though "0" minute may sometimes arise; and where a specific notation, for example, "0" is used to denote the last day of the preceding month when the time-counting circuit makes a zero count, then the display of said specific notation "0" obviously shows that the first day of the current month has been backdated to the last day of the preceding month, no matter what day represents the last day of said preceding month. Therefore, the global timepiece of this invention eliminates the necessity of providing a complicated judgment circuit for distinguishing the last day of the preceding month in correcting a calendar month of the base district.

DETAILED DESCRIPTION

Figure 1:
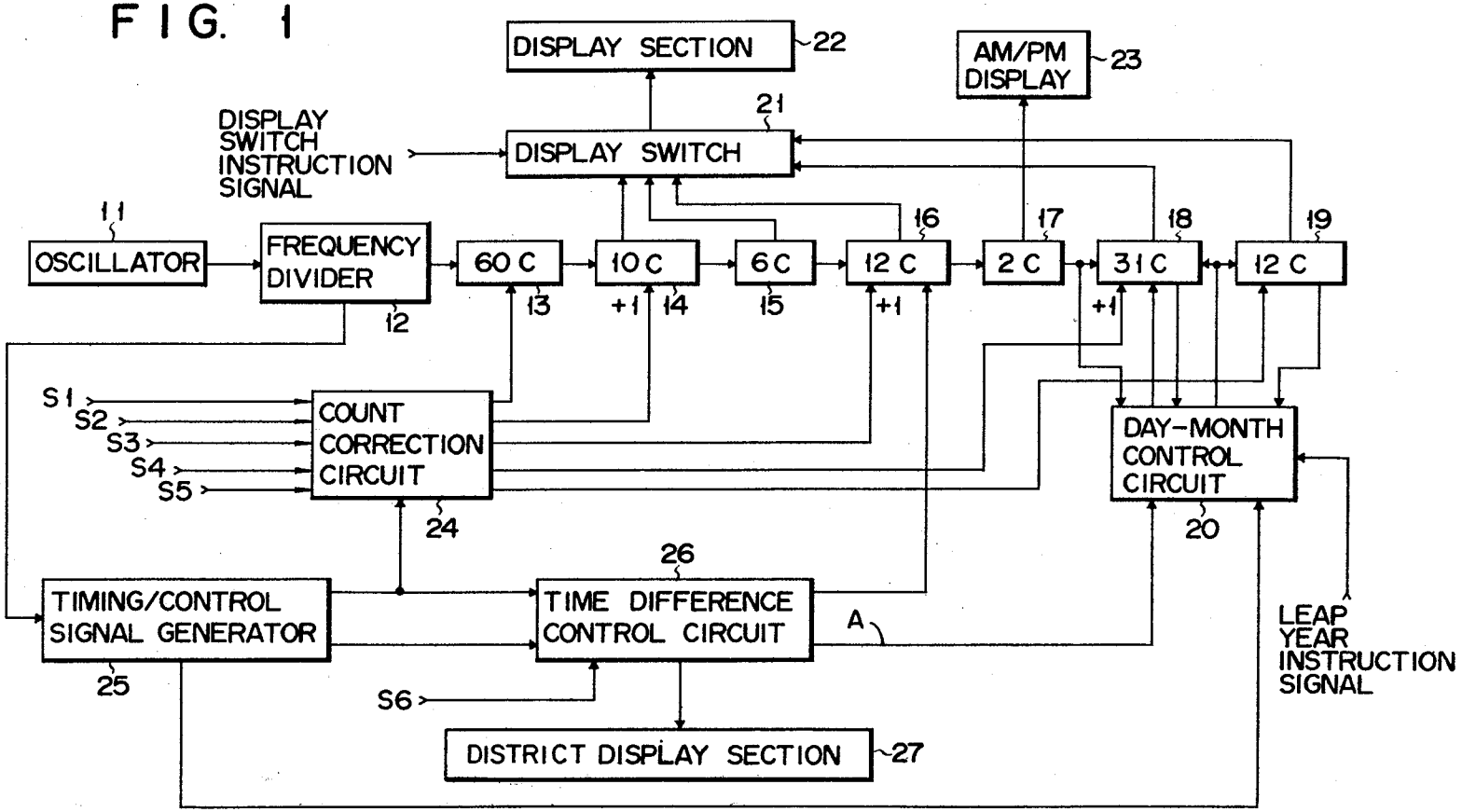
FIG. 1 is a block circuit diagram of the arrangement of a global timepiece embodying this invention.

Referring to FIG. 1, clock pulses sent forth from a clock pulse oscillator 11 are converted into time-counting signals of one pulse per second (1p/1sec) by a frequency divider 12. This 1p/1sec signal is supplied for upcounting to a 60-scale second counter 13. A per minute carry signal sent forth from the 60-scale second counter 13 is delivered for upcounting to a 10-scale counter 14 for counting a number of minutes indicated in the first digit position of a minute section. A per minute carry signal from said second counter is further conducted to a counter 15 for counting a number of minutes shown in the second digit position of the minute section. The counter 15 generates a carry signal per hour, which in turn is supplied for upcounting to a 12-scale hour counter 16. A per-12 hours carry signal from said hour counter 16 is conducted to a 31-scale day counter 18 for every 24 hours though a 2-scale counter 17. An output signal from the 31-scale day counter 18 is counted up in a 12-scale month counter 19. The day counter 18 and month counter 19 are controlled by a day-month control circuit 20. A number of counted days for which an advance signal is issued from the day counter 19 to the month counter 19 is determined for each calendar month. Each time the month counter 19 makes an advance, the counts made by the day counter 18 are preset at 1, enabling the days and months to be always correctly counted. In this case, the day-month control circuit 20 is supplied, if necessary, with a leap year instruction signal. Namely in February of a leap year, the day counter 18 issues an advance instruction to the month counter 19 when the day counter 18 has counted 29 days.

The counters 13 to 19 constitute a time-counting circuit. Counts made by the counters 14 to 17 corresponding to "minutes" and "hours" and counts made by the day counter 18 and month counter 19 are supplied to a display switch 21. A display section 22 is operated by momentarily switched counts of "minutes," "hours," "days" and "months" to display the current time and date. Counts made by the 2-scale counter 17 control indications on the AM-PM display section 23.

The above-mentioned counters 13 to 19 are supplied with a signal from a count correction circuit 24, which in turn receives signals from switches S1 to S5 corresponding to "seconds," "minutes," "hours," "days" and "months." A signal from the switch S1 clears the "second" counter 13. The switches S2 to S5 cause an advance of counting to be made in the corresponding counters 14, 16, 18, 19 to correct the counts previously made thereby, namely, the indication of time and date.

The frequency divider 12 sends forth a signal of a fully short period to a timing-control signal generator 25. This signal generator 25 issues clock pulses $0_e$ for driving the aforesaid counters 13 to 19 and control pulses whose number is defined according to said clock pulses $0_e$. The clock pulses $0_e$ and control pulses are supplied to control the operation of the day-month control circuit 20, count correction circuit 24 and time difference control circuit 26. The time difference control circuit 26 is supplied with a district-designating signal through a switch S6. The name of a designated district is shown on a district display section 27. A signal denoting a time difference occurring between the current time of a base district and the corresponding time of the designated district is supplied to the hour counter 16. The operation of the display switch 21 is changed over by a switch S7 (FIG. 5) to supply the display section 22 with counts denoting either time or date.

Figure 2:
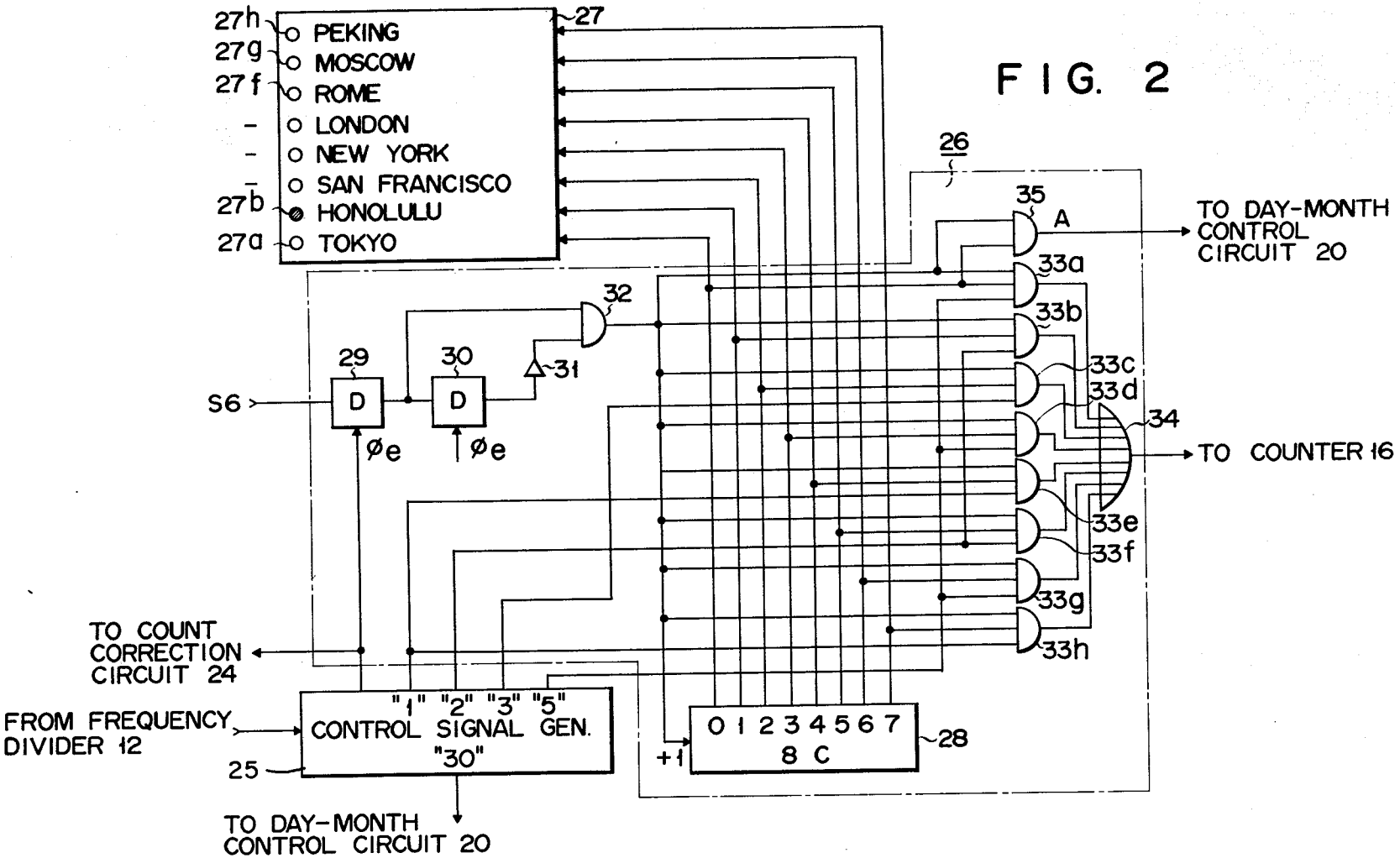
FIG. 2 shows a logic circuit including the time difference-indicating circuit of FIG. 1.

FIG. 2 shows a concrete example of the time difference control circuit 26. This embodiment relates to the case where it is desired to find the current time of eight cities: Peking, Moscow, Rome, London, New York, San Francisco, Honolulu and Tokyo. The district display section 27 is provided with eight display means **27*a* to 27*h*** arranged in the order corresponding to the above-mentioned linearly arranged eight cities.

With a timepiece using a time-counting circuit, upcounting generally serves the purpose, because it represents the customary time-counting mode. However, correction of counts based on a time difference is effected by down counting. Namely, where a calendar day is to be corrected, said correction generally has to be carried out by causing the day counter to make a subtraction of "−1". Where, however, time correction based on a time difference is made, using an upcounter instead of an up-down counter, and said time correction occurs particularly on the first day of the current month of a base district having, for example, 31 days, then it is advised to add a complement of 30 days to one day as counted from said 31 days to a count denoting days past before said time correction based on the time difference (in this case a count denoting one day.) Then, up counting can carry out the same function of effecting a subtraction of "−1".

There will now be described the embodiment of FIG. 2, wherein addition of the above-mentioned complement can effect the same function as subtraction. The time difference control circuit 26 is provided with a 8-scale counter 28 comprising eight count output lines corresponding to the eight display means **27*a* to 27*h*. The 8-scale counter 28 is advanced in counting each time the switch S6 is operated and designates any of the aforesaid eight cities through the corresponding output line. An actuating signal from the switch S6 is supplied in series to delay circuits 29, 30 formed of, for example, delayed flip-flop circuits operated in synchronization with a clock pulse $0_e$. An inverter 31 is connected to the output side of the delay circuit 30. An output signal from the delay circuit 29 and an output signal from the inverter 31 are conducted to an AND circuit 32. A one shot pulse is generated from the AND circuit 32 with a clock pulse time width equal to the delay time of delay circuit 30. The 8-scale counter 28** is advanced in counting in such timing corresponding to the rear or trailing edge of the one shot pulse.

Output signals corresponding to the counts made by the 8-scale counter 28, together with an output signal from the AND circuit 32, are supplied to AND circuits **33*a* to 33*h*. Output signals from the AND circuits 33*a* to 33*h* are conducted as count signals to the hour counter 16 of FIG. 1 through an OR circuit 34**.

Figure 3:
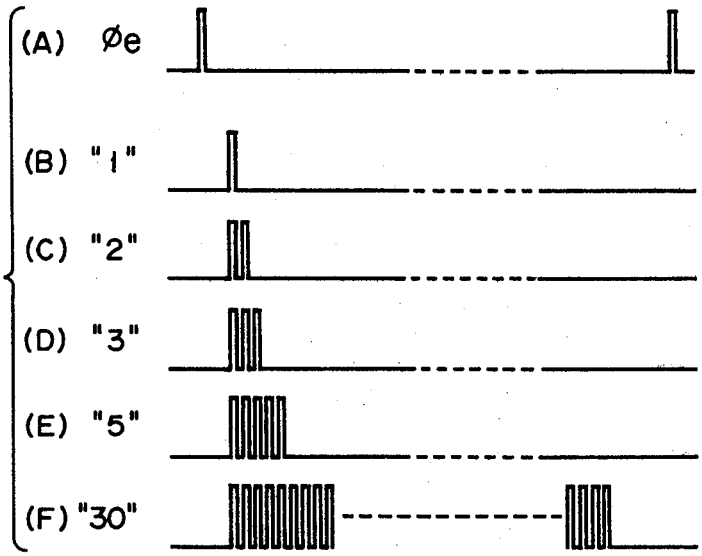
FIGS. 3A to 3F indicate the wave forms of signals sent forth from the timing-control signal generator of FIG. 1.

The timing-control signal generator 25 properly divides the frequency of a signal from the frequency divider 12, counts the divided portions of said signal, and generates clock pulses $0_e$ shown in FIG. 3A, and further one, two, three, five and thirty count pulses shown in FIGS. 3B to 3F during an interval between the above-mentioned two clock pulses of FIG. 3A. The one count pulse is delivered to the AND circuits 33e, 33h, the two count pulses to the AND circuits 33b, 33f, the three count pulses to the AND count 33c, the five count pulses to the AND circuits 33a, 33d, 33g and the thirty count pulses to the day-month control circuit 20. An output count "0" corresponding to Tokyo which has been issued from the 8-scale counter 28 is delivered to an AND circuit 35, together with an output from the AND circuit 32. An output signal A from the AND circuit 35 is delivered as an instruction to the day-month control circuit 20.

Figure 4:
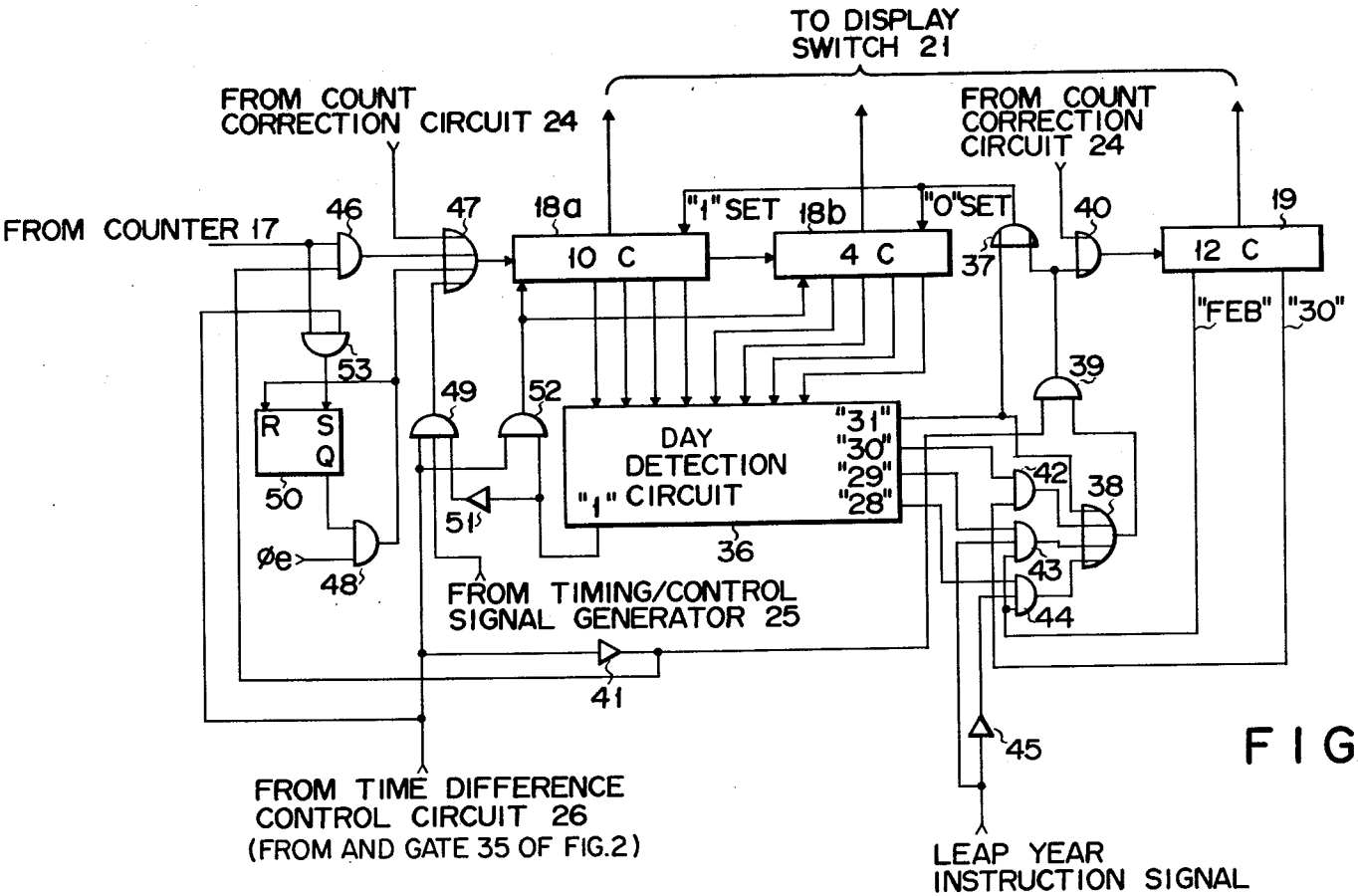
FIG. 4 shows the relative arrangement of the concrete day-month indicating circuit and the count correction circuit of FIG. 1.

FIG. 4 shows in greater detail a section associated with the day-month control circuit 20. The day counter 18 is divided into a 10-scale counter 18a and 4-scale counter 18b. Output count signals of, for example, 4 bits sent forth from the counters 18a, 18b are supplied to a day-detecting circuit 36 which in turn produces a detection count signal denoting any of the 28th, 29th, 30th and 31st days representing the last day of a given calendar month on which time correction based on a time difference is to be made. The month counter 19 produces count signals corresponding to the even months of February, April, June, September and November. A "31 days" signal from the day detecting circuit 36 is sent to OR circuits 37, 38. An output signal from the OR circuit 37 is supplied to the counter 18a as an instruction to set a count already stored therein at "1" and to the counter 18b as an instruction to set a count already stored therein at "0". An output signal from an OR circuit 37 sets the count made by the day counter 18 at "1" corresponding to one day. An output signal from the OR circuit 38 is sent forth through an AND circuit 39 to the OR circuit 37 and an OR circuit 40. An output signal from the OR circuit 40 is supplied as an advance signal to the month counter 19. The OR circuit 40 receives a month-correcting signal from the count correction circuit 24. An output signal from an inverter 41 which receives the signal A from the time difference control circuit 26 is supplied as a gate signal to the AND circuit 39.

Output detection signals from the day detecting circuit 36 which denote the 30th, 29th and 28th days are conducted to the corresponding AND circuits 42, 43, 44. Output signals from the AND circuits 42, 43, 44 are carried to the OR circuit 38. An output detection signal from the month counter 19 which shows any of the even months except for February is supplied as a gate signal to the AND circuit 42. An output detection signal from said month counter 19 which represents February is sent as a gate signal to the AND circuits 43, 44. The AND circuit 43 is supplied with a leap year instruction and also with an output signal from an inverter 45 associated with said AND circuit 43.

An output signal from the inverter 41 is supplied as another gate signal to an AND circuit 46 which receives an output signal from the 2-scale counter 17. An output signal from the AND circuit 46 is delivered as an advance signal to the counter 18a through an OR circuit 17. The OR circuit 47 is supplied with a day correction signal sent forth from the count correction circuit 24 through the switch S4 and output signals from AND circuits 48, 49. The AND circuit 48 has its gate opened when a flip-flop circuit 50 is set and issues a clock pulse $0_e$. The flip-flop circuit 50 is set by a signal supplied from the 2-scale counter 17 through an AND circuit 53, and is reset by an output signal from the AND circuit 48. The other gate of the AND circuit 53 is supplied with an output signal from the time difference control circuit 26. The AND circuit 49 receives the signal A from the time difference control circuit 26, thirty count pulses from the timing-control signal generator 25 and an output signal from the inverter 51. The inverter 51 is supplied with an output detection signal showing one day from the day detecting circuit 36. The "one day" detecting signal and the signal A are coupled to the AND circuit 52. An output signal from the AND circuit 52 is supplied to the counters 18a, 18b to set the counts stored therein at "0".

Figure 5:
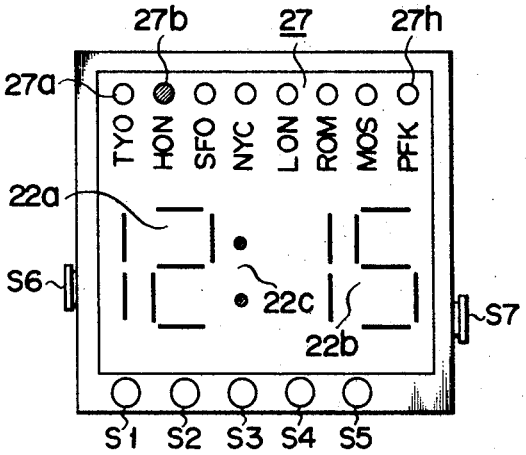
FIG. 5 is a plan view of a display panel included in the global timepiece of the invention.

FIG. 5 illustrates the display panel of the global timepiece arranged as described above. The display panel comprises two count display sections 22a, 22b which respectively indicate "hours" and "minutes", and are each formed of two digit positions, and further a district display section 27 provided with eight display means 27a to 27h. The display panel also has switches S1 to S5 linearly arranged at the lower part thereof to correct counts made by the counting circuit, and a switch S6 fitted to the left side wall to introduce a time difference control instruction and a switch S7 fitted to the right side wall to indicate "months" and "days" instead of "hours" and "minutes". If dot portions 22c disposed between the count display sections 22a, 22b are intermittently lighted by 1p/1sec pulses supplied to the second counter 13, then counts denoting seconds are indicated.

Where the global timepiece of the above-mentioned arrangement is used, for example, in Tokyo, Japan, then the count of the 8-scale counter 28 is set at "0", namely, at Tokyo by operation of the switch S6. In this case, counts made by the time-counting circuit are so set as to correspond to the current time of Tokyo. Namely, the count display sections 22a, 22b indicate the current time of Tokyo. If the switch 7 is operated, the current date of Tokyo is shown. As is apparent from FIG. 4, the day counter 18 is advanced in counting each time a carry signal is supplied thereto from the counter 17. The count thus made represents the current calendar day. Counts made by the month counter 19 distinguishes between the even and odd months, thereby determining the last day of a given month and also judging whether time correction based on a time difference should extend to the first day of the following month. As the result, counts denoting "days" and "months" are automatically advanced.

Figure 6:
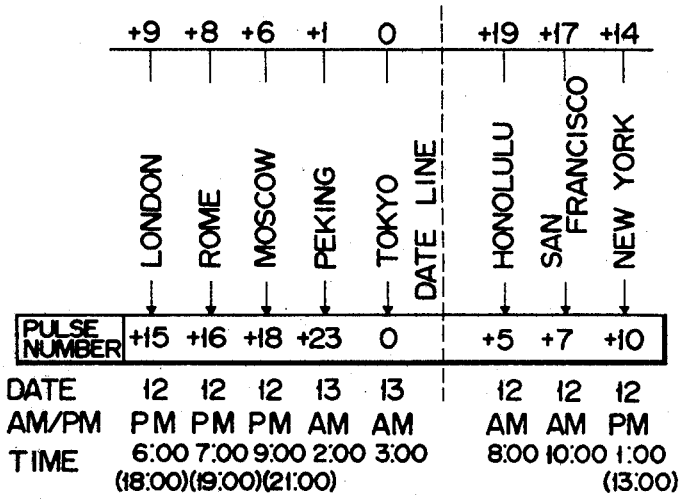
FIG. 6 shows time differences between Tokyo taken as a base district and other optional cities over the world which are used with the global timepiece of the invention.
Figure 7:
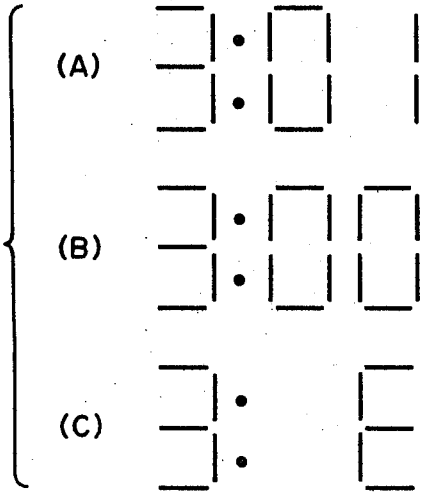
FIGS. 7A to 7C illustrate the manner in which the current time of the base district is corrected based on a time difference.

FIG. 6 shows the relative time differences occurring between every adjacent ones of the aforesaid eight cities linearly arranged on the display panel which are used with the subject global timepiece. With Tokyo taken as a base district represented by "0," Honolulu has a time difference of 19 hours with the intervening date line taken into account. San Francisco has a time differnce of 17 hours, and New York a time difference of 14 hours, Peking has a time difference of 1 hour; Moscow 6 hours; Rome 8 hours; and London 9 hours. With the current time of Tokyo chosen to be 3.00 AM on the 13th day, the corresponding points of time of the other cities are given below them on the display panel. If the hour counter is considered to be of a 24-scale type formed of a combination of the counters 16, 17, and pulses are added as an advance signal to the hours counted at Tokyo which are initially set at "0" as mentioned above, then addition of a complement to hours corresponding to a given time difference as counted from 24 hours enables the current time of any other desired city to be counted by the hour counter, instead of subtracting hours corresponding to the time difference from 24 hours.

Where it is desired to find the current time at, for example, Honolulu on the subject global timepiece with the time-counting circuit so set as to indicate the current time of Tokyo taken as a base, then it is advised to operate the switch S6 once and advance the 8-scale counter 28 one step to obtain an output count of "1". When the counter 28 counts "1," the display means **27*b* for Honolulu provided in the district display section 27 is operated to indicate the current time of Honolulu. Immediately before operation of the switch S6, the counter 28 remains in a "0" count state to designate Tokyo. Upon operation of the switch S6, therefore, the gate of the AND circuit 33*a* is opened. As the result, five pulses sent forth from the timing-control signal generator 25 are drawn out through the OR circuit 34. The hour counter 16 is advanced five times to make a time correction of five hours. The signal A delivered from the AND circuit 35 is supplied to the AND circuit 49 of FIG. 4. Where, in this case, the count made by the day counter 18 does not represent the first day of the current month, namely, where time correction does not extend to the preceding month, but said time correction occurs within the same month, then thirty pulses are supplied to the day counter 18 through the AND circuit 49, because an output from the inverter 51 denotes a count of "1". In this case, generation of the signal A causes the inverter 41 reproduce a "0" output. Since the gate of the AND circuit is closed, the month counter 19 is not advanced in counting, though the day counter 18 is advanced in counting. Thus the day counter 18** is so set as to indicate the immediately preceding date upon receipt of the aforesaid 30 pulses.

Where the current time of Tokyo taken as a base is 3.00 AM on the 13th day as illustrated in FIG. 6, and an output produced by operation of the switch S6 designates Honolulu, then a complement of "+5" to the time difference of 19 hours as counted from 24 hours is added to the time-counting circuit 18 to set it at 8.00 AM on the 12th day, thus indicating the current time of Honolulu on the display sections **27*b*, 22*a*, 22*b***.

Where the current time of Honolulu and that of Tokyo fall on the same day, it is advised to supply a carry signal from the counter 17 and the signal A sent forth from the time difference control circuit 26 by switch operation to the gate of the AND circuit 53, set the flip-flop circuit 50 by an output from the AND circuit 53, and supply a clock pulse $0_e$ to the day counter 18 through the AND circuit 48 and OR circuit 47. Namely, where the current time of the base district of Tokyo is corrected on the basis of a time difference between Tokyo and any other selected district, then it is advised forcefully to cause the day-counting circuit 18 to make a count of "−1" with the date line taken into account and, after the counting by the hour counters 16, 17, judge whether the time correction falls within the same day or extends over to the preceding day depending on the presence or absence of a carry signal. Where the switch S6 is further operated under the abovementioned condition, then the 8-scale counter 28 makes a count of "2" to designate San Francisco. Upon operation of the switch S6, the AND circuit **33*b* sends forth two signals. Since, at this time, the AND circuit 35 does not produce any output, the signal A is not issued. As the result, two advance signals are added to a complement of "+5" already stored in the hour counter 16. Eventually, a complement of "+7" corresponding to San Francisco is added to indicate "10.00 AM on the 12th day". As the switch S6 is later operated in succession, the other districts than Tokyo are designated in turn. When pulses of a number corresponding to a difference between the time differences of every adjacent ones of the eight cities as measured from the base district of Tokyo are drawn out from the time difference control circuit 26**, then the current times of the other cities than Tokyo can be indicated in the form of a date, together with the AM-PM designation.

Where a "day" count made by the day counter 18 represents the first day of a calendar month of Tokyo, it sometimes becomes necessary to indicate the last day of the preceding calendar month of, for example Honolulu, when this city is designated, depending on the point of time at which it is desired to find the time difference of Honolulu by operation of the switch S6. Depending on said preceding calendar month, the last day thereof denotes different days as the 31st, 30th, 28th and 29th days. If such different last days have to be distinguished, then the process of counting the day will be complicated. In this case, it is advised to find the day count corresponding to the first day of a calendar month by the day detecting circuit 36 upon operation of the switch S6, close the gate of the AND circuit 49 by a "first day" detecting output from said day detecting circuit 36, supply the counters **18*a*, 18*b* through the AND circuit 52 with an instruction to set the counts of said counters 18*a*, 18*b* at "0." Where the current date of, for example, Tokyo is March 1st (3:01) as illustrated in FIG. 7A, then the current date of Honolulu is indicated in the form of 3:00 as shown in FIG. 7B, thereby forcefully causing said date indication to denote the last day of February unconditionally, that is, regardless of whether February ends with the 28th or 29th day. Or it is possible to issue an instruction to display a specific notation upon receipt of a signal denoting the "0" count of the day counter 18 and present a display of "3:E" as shown in FIG. 7C** in order to indicate that the current date of, for example, Honolulu is the last day of February.

The foregoing embodiment refers to the case where the seven other cities than Tokyo of FIG. 5 were successively designated to find a time difference between the base district of Tokyo and any of said designated cities. However, it is possible immediately to correct the current time of the base district of Tokyo by reference to a time difference between Tokyo and, for example, London or Rome with the intervening cities left out.

As mentioned above, this invention has the advantages that where the first day of the current month of a base district is backdated one day as the result of time correction based on a time difference between the current time of the base district and that of any other remote district over the world to indicate the last day of the preceding month of said another district, then said time correction can be carried out without affecting the normal operation of the month counter and also without the necessity of determining on what day the last day of the preceding month falls. Moreover, where the subject timepiece is used as an ordinary timepiece, a normal date indication can be continued by causing the date to be advanced one day after another. Therefore, this invention displays a prominent effect in simplifying the arrangement of a day-detecting circuit and also rendering, for example, a wrist watch applicable as a global timepiece.

What is claimed is:

1. A global timepiece comprising: '(a) a source of clock pulse signals;

(b) a counter circuit coupled to said clock pulse signal source and responsive to said clock pulse signals, said counter circuit including at least a time-counting circuit for electronically counting the time of the day of a basic district, a day-counting circuit for electronically counting days of said basic district, and a month-counting circuit for electronically counting months of said basic district;

(c) control means coupled to said counter circuit and responsive at least to the day count of said day-counting circuit for switching the last day of a given month to the first day of the next month in accordance with the calendar;

(d) designating means for designating a district which has a time which is different from the time of said basic district;

(e) time correction means coupled to said designating means for supplying a time difference signal representative of the time difference between times of the basic district and of the designated district to at least said time-counting circuit of said counter circuit to thereby change the current time of the basic district to the current time of the designated district;

(f) detector means coupled to said designating means for detecting that the current date of said designated district precedes the current date of said basic district and for producing a detection output responsive to said detection;

(g) day-detecting means coupled to said day-counting circuit for detecting whether the date of said basic district is the first day of a month;

(h) means coupled to said day-detecting means and to said day-counting circuit for subtracting a count of "1" from the count of said day-counting circuit when said day-detecting means detects that the date of said basic district is not the first day of a month;

(i) converting means coupled to said day-detecting means, to said detector means and to said day-counting circuit for converting the count value of said day-counting circuit into a specific code which represents a notation which differs from the notations corresponding to the numerals on the ordinary calendar when both said day-detecting means detects that the date of said basic district is the first day of a month and said detector means produces said detection output; and (j) display means coupled at least to said converting means for indicating the data represented by said specific code.

2. A global timepiece according to claim 1 wherein said display means includes means responsive to said specific code for indicating a notation "0" in the day-of-month position on said display means which is different from the numerical characters appearing on an ordinary calendar.

3. A global timepiece according to claim 1 wherein said display means includes means responsive to said specific code for indicating a specific notation in the day-of-month position on said display means which is different from the numerical characters appearing on an ordinary calendar.

4. A global timepiece according to claim 3 wherein said specific notation is an alphabetical character.

5. A global timepiece according to claim 1 wherein said specific code represents a notation "00".

6. A global timepiece according to claim 1 wherein said specific code represents an alphabetical character.

7. A global timepiece according to claim 6 wherein said specific code represents a notation "E."

8. A global timepiece according to claim 1 wherein said means for designating a district which has a different time from the time of said basic district comprises an n-scale counter and a switch means coupled to said n-scale counter and operable by the user of the timepiece to change the count value of the n-scale counter, the count value of said n-scale counter corresponding to the designated district, said time correction means being coupled to the outputs of said n-scale counter.

9. A global timepiece according to claim 1 wherein said detector means generates said detection output only when the international dateline lies between said basic district and said designated district.

10. A global timepiece according to claim 1 wherein said converting means comprises AND gate means for producing an output only when both said day-detecting means detects that the date of said basic district is the first day of a month and said detector means produces said detection output, the output of said AND gate means being supplied to said day-counting circuit for converting the count value thereof into said specific code.

* * * * *